US009339706B2

(12) United States Patent
Black, Jr. et al.

(10) Patent No.: US 9,339,706 B2
(45) **Date of Patent: *May 17, 2016**

(54) GOLF TEEING DEVICE

(71) Applicant: TEE-CLAW LLC, Tustin, CA (US)

(72) Inventors: John Luther Black, Jr., Costa Mesa, CA (US); John Efrin Candias, Newport Beach, CA (US)

(73) Assignee: Tee Claw LLC, Tustin, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/579,164

(22) Filed: Dec. 22, 2014

(65) Prior Publication Data

US 2015/0105182 A1 Apr. 16, 2015

Related U.S. Application Data

(63) Continuation-in-part of application No. 13/918,027, filed on Jun. 14, 2013, now Pat. No. 8,968,118.

(51) Int. Cl.
*A63B 57/10* (2015.01)
*A63B 69/36* (2006.01)
(Continued)

(52) U.S. Cl.
CPC ..... *A63B 57/0018* (2013.01); *A63B 57/005* (2013.01); *A63B 57/10* (2015.10); *A63B 57/12* (2015.10); *A63B 69/3623* (2013.01); *A63B 2071/0694* (2013.01)

(58) Field of Classification Search
CPC ..... A63B 57/10; A63B 57/12; A63B 57/15; A63B 57/0006; F16B 23/00; F16B 2/005; F16B 2/14
USPC ..... D21/717, 718
See application file for complete search history.

(56) References Cited

U.S. PATENT DOCUMENTS 1,413,496 A 4/1922 Sibbald
1,696,136 A * 12/1928 Coburn ..... A63B 57/10 473/387

(Continued)

FOREIGN PATENT DOCUMENTS

AU 2003-282236 A1 6/2004
AU 2003-303514 A1 7/2004

(Continued)

OTHER PUBLICATIONS

Shenzhen AJD Enterprise Co., Ltd.; 4 of set winter golf tees (size:12 17 22 37mm), rubber golf tee, golf tee, golf accessory; lulusoso.com; Mar. 12, 2012; 5 pages; China; http://sell.lulusoso.com/selling-leads/714661/4-of-set-winter-golf-tees-size-12-17-22-37mm-rubber-golf-tee-golf-tee-golf-accessory.html.

(Continued)

*Primary Examiner* — Steven Wong
(74) *Attorney, Agent, or Firm* — Hankin Patent Law APC; Kevin Schraven; Anooj Patel

(57) ABSTRACT

A golf teeing device. The golf teeing device may engage with a surface, such as an artificial golf mat, such that the user may conveniently place a golf ball to be hit. The golf teeing device may comprise a base and a top, wherein the base has extensions or hooks that extend in a substantially downward and sideways manner. These hooks, when rotated, grip into the artificial golf mat and hold the golf teeing device in place on the mat. The top portion of the golf teeing device may be configured to engage with a golf ball and/or golf tee.

19 Claims, 10 Drawing Sheets

(51) Int. Cl.
*A63B 57/00* (2015.01)
*A63B 71/06* (2006.01)

(56) References Cited

U.S. PATENT DOCUMENTS

| | | | | | |
|---|---|---|---|---|---|
| 1,936,625 | A | | 11/1933 | Goldman | |
| 2,079,387 | A | * | 5/1937 | Sickmiller | A63B 57/10 248/161 |
| 3,254,890 | A | * | 6/1966 | Watson | A63B 57/10 473/396 |
| 3,406,977 | A | | 10/1968 | Voelkerding | |
| 5,085,431 | A | | 2/1992 | McGuire | |
| 5,156,403 | A | | 10/1992 | Martino | |
| D349,318 | S | * | 8/1994 | Rubin | D21/718 |
| 5,658,110 | A | | 8/1997 | Kraus | |
| 5,766,100 | A | | 6/1998 | Dilmore | |
| 5,967,909 | A | | 10/1999 | Broadbridge | |
| 6,024,654 | A | | 2/2000 | Chun | |
| 6,062,989 | A | | 5/2000 | Wagner | |
| 6,110,060 | A | * | 8/2000 | Spoto | A63B 57/10 473/396 |
| 6,735,819 | B2 | | 5/2004 | Iverson et al. | |
| 6,746,340 | B1 | | 6/2004 | Dover | |
| 7,094,163 | B2 | * | 8/2006 | Lu | A63B 57/10 473/396 |
| D533,241 | S | * | 12/2006 | Calhoon | D21/717 |
| 7,303,493 | B1 | | 12/2007 | Ehresman | |
| 7,846,044 | B2 | | 12/2010 | Sagadevan | |
| D657,431 | S | * | 4/2012 | Chilton | D21/717 |
| 8,622,853 | B1 | | 1/2014 | Roland | |
| 8,968,118 | B2 | * | 3/2015 | Black, Jr. | A63B 57/0018 473/386 |
| 2004/0132554 | A1 | | 7/2004 | Schulze | |
| 2004/0185967 | A1 | | 9/2004 | McDonough et al. | |
| 2005/0277489 | A1 | | 12/2005 | Choe | |
| 2006/0035728 | A1 | | 2/2006 | Chang | |
| 2006/0058120 | A1 | | 3/2006 | Anton | |
| 2006/0079350 | A1 | | 4/2006 | Lu | |
| 2006/0105859 | A1 | | 5/2006 | Emmerson | |
| 2007/0167259 | A1 | | 7/2007 | Lipidarov | |
| 2007/0202966 | A1 | | 8/2007 | Lipidarov | |
| 2008/0102988 | A1 | | 5/2008 | Sagadevan | |
| 2008/0146383 | A1 | | 6/2008 | Dandelius | |
| 2009/0137345 | A1 | | 5/2009 | Sagadevan | |
| 2010/0075782 | A1 | | 3/2010 | Stiles | |
| 2012/0214616 | A1 | | 8/2012 | Lipstock | |
| 2014/0090233 | A1 | | 4/2014 | Kochheiser | |

FOREIGN PATENT DOCUMENTS

| | | | |
|---|---|---|---|
| CA | 2263700 | A1 | 10/1999 |
| CA | 2263700 | C | 5/2001 |
| EP | 1812127 | A1 | 8/2007 |
| GB | 0226470 | | 11/2002 |
| GB | 0509322 | | 11/2003 |
| GB | 2409821 | A | 7/2005 |
| GB | 2409821 | B | 2/2006 |
| SE | 0402837 | | 11/2004 |
| WO | 2004043551 | A1 | 5/2004 |
| WO | 2004-060501 | A1 | 7/2004 |
| WO | 2006-054948 | A1 | 5/2006 |
| WO | 2010-033831 | A2 | 3/2010 |
| WO | 2010-033831 | A3 | 6/2010 |

OTHER PUBLICATIONS

SKLZ Training Center; Brush Tee Replacement; 2 pages; http://www.sklz.conn/sports-training/parts/baseballsoftball/fastpitch-brush-tee-replacement?gclid=CP_k0o-dl7cCFQVV4Aodh1lAsA.

International Search Report for PCT/US2014/042280, Dec. 15, 2015.

* cited by examiner

GOLF TEEING DEVICE

CROSS-REFERENCE TO RELATED APPLICATIONS

This application is a continuation-in-part of U.S. Utility patent application Ser. No. 13/918,027, filed on Jun. 14, 2013, titled "GOLF TEEING DEVICE", by inventors John Luther Black Jr. and John Efrin Candias, the contents of which are expressly incorporated herein by this reference, and to which benefit is claimed.

FIELD OF USE

The present disclosure generally relates to golf tees, golf tee holders, golf teeing devices, and methods of use thereof. More specifically, the present disclosure relates to devices that rotateably engage with a surface, such as an artificial grass golf mat, or those devices that act as a golf tee.

BACKGROUND

The modern game of golf originated in Scotland during the 15th century. Since its inception, golf has globally risen in popularity worldwide. Whether golf is played for the purpose of exercising, passing time outdoors, providing an outlet to escape the day-to-day strains and worries, building social and business contacts, spending time with loved ones, or just enjoying the challenge of the sport itself, golf has generally transformed into a highly desirable sport for golfers of all levels with different golfing preferences.

Although an increasing number of golfers are picking up the sport, driving ranges that allow golfers to practice are generally ill-equipped to accommodate the varying levels and preferences of the players. Many driving ranges generally utilize artificial grass mats that can pose many challenges to golfers. These artificial grass mats may cause golfers to either: (1) hit directly on the surface of the artificial grass mat, thereby causing the golfer to alter his or her golf swing, or (2) hit the bulky rubber tee that is inserted through a hole in the artificial grass mat. The bulky rubber tee is generally not adjustable and typically requires the user to lift the dirty mat, brave the bugs living under the mat, and push the rubber tee upwards through the hole.

In addition to its difficult installation and removal, the standard rubber tee typically has many other deficiencies. For example, one deficiency is the difficulty in predicting the golf ball trajectories when golf balls are hit from the standard rubber tee. This deficiency is usually exacerbated by the fact that golfers may directly hit the surface of the golf mat itself.

Another deficiency is the difficulty of installing a rubber tee on the artificial grass mat. Many golfers prefer to place a rubber tee on a fixed position, which does not accommodate both right- and left-handed golfers, many of whom would prefer to place the ball elsewhere on the mat while retaining the ability to strike the ball from a raised height. This is further exacerbated by the fact that the rubber tee itself does not accommodate various height positions of the golf ball, as the golf ball rests on the tee.

To address these issues, there have been dozens, if not hundreds, of devices to remedy the deficiencies of the standard bulky rubber tee. U.S. Patent Application Publication Number 2008/0146383, filed by Dandelius, discloses a golf tee device that fits into the hole of a golf mat from the top and generally supports a golf tee. Although the Dandelius golf tee device does allow the user to forego having to lift the golf mat, the Dandelius device has its own deficiencies, including being complex and expensive to manufacture, and having two separate parts. Moreover, the Dandelius device generally is limited to being placed only in the standard hole that was already in the golf mat to accommodate the bulky rubber tee. This generally prevents users from engaging the mat in any other location. Finally, the Dandelius device generally does not allow the user to install the standard wooden tee or vary the height of the ball placement.

Additionally, U.S. Patent Application Publication Number 2007/0167259, filed by Lipidarov, discloses a golf tee device that is more flexible than the Dandelius device. Unfortunately, the Lipidarov golf tee device is even more complex and still requires the user to use the existing hole in the golf mat.

Moreover, U.S. Patent Application Publication Number 2004/0132554, filed by Schulze, discloses a golf tee holder that engages with a standard wooden tee. The Schulze golf tee holder, however, still must be placed under an artificial grass mat.

Thus, what is needed is a reusable, easy-to-use, inexpensive golf tee that securely grips on to a golfing surface, including an artificial grass mat, at any location on the mat, and that can easily be removed from the surface.

SUMMARY OF EMBODIMENTS

To minimize the limitations in the cited references, and to minimize other limitations that will become apparent upon reading and understanding the present specification, the following discloses a new and useful golf tee and golf tee holder device.

One embodiment of the golf teeing device comprises: a top portion; a base portion; and a lanyard anchoring portion. The base portion may comprise two or more extensions; wherein the two or more extensions may be configured to removeably and securely engage with a surface. The top portion may be configured to cradle a golf ball. The two or more extensions are located substantially near an outer rim of the base portion. The two or more extensions may be substantially hooked-shaped, such that the two or more extensions first extend substantially downward away from the base portion and then extend substantially horizontal and substantially parallel to the base portion. The golf teeing device may further comprise a lanyard, wherein the lanyard is configured to engage with the lanyard anchoring portion. The golf teeing device may further comprise: a standard tee engagement portion; wherein the standard tee engagement portion is configured to matingly engage with a standard tee, such that the standard tee cradles a golf ball. The standard tee engagement portion may comprise a hole; wherein an edge of the hole is configured to matingly engage with the standard tee, such that the standard tee cradles the golf ball. The lanyard anchoring portion may be an extrusion on an underside of the golf teeing device. The lanyard anchoring portion may be aligned with the hole, such that a standard tee that engages with the hole is substantially prevented from passing through the lanyard anchoring portion. The lanyard may comprise one or more loops such that the one or more loops are configured to engage the lanyard anchoring portion. The lanyard anchoring portion may be substantially circular and may comprise a groove around a circumference outside portion of the lanyard anchoring portion. The groove may be configured to matingly engage with the one or more loops of the lanyard. The base portion may further comprise one or more grip notches. The two or more extensions may be placed equidistant from each other along the outer rim of the base portion, may be hooked in the same direction as each other, and may be configured to engage with the surface by rotating the golf teeing device as the two or more extensions are in contact with the surface. The two or more extensions may comprise one or more serrated edges. The hole may be configured to matingly engage with a standard tee, such that a height of a golf ball placed on the standard tee is adjustable. The surface is preferably a golf mat. The top portion may be constructed of a soft polymer material. The base portion may be constructed of a hard p material. The two or more extensions may be four extensions.

Another embodiment of the golf teeing device comprises: a top portion; and a base portion. The base portion may comprise two or more extensions, which may be configured to removeably and securely engage with a surface. The top portion is configured to cradle a golf ball. The two or more extensions may be substantially hooked-shaped, such that the two or more extensions first extend substantially downward away from the base portion and then extend substantially horizontal and substantially parallel to the base portion. The golf teeing device may further comprise: a lanyard anchoring portion. The two or more extensions may be substantially located substantially near an outer rim of the base portion. The golf teeing device may further comprise: a lanyard; and a standard tee engagement portion. The lanyard may be configured to engage with the lanyard anchoring portion. The standard tee engagement portion may be configured to matingly engage with a standard tee, such that the standard tee cradles a golf ball. The standard tee engagement portion may comprise a hole; wherein an edge of the hole is configured to matingly engage with the standard tee, such that the standard tee cradles the golf ball. The lanyard anchoring portion may be an extrusion on an underside of the golf teeing device; wherein the lanyard anchoring portion may comprise a lanyard anchoring hole that may be configured to engage with the standard tee. The lanyard may comprise one or more loops such that the one or more loops may be configured to engage the lanyard anchoring portion; wherein the lanyard anchoring portion may be substantially circular and may comprise a groove around a circumference outside portion of the lanyard anchoring portion. The groove may be configured to matingly engage with the one or more loops of the lanyard. The base portion may further comprise one or more grip notches. Preferably, each of the two or more extensions may be placed equidistant from each other along the outer rim of the base portion, may be hooked in the same direction as each other, and may be configured to engage with the surface by rotating the golf teeing device as the two or more extensions are in contact with the surface. The two or more extensions may comprise one or more serrated edges. The top portion may be constructed of a soft polymer material and the base portion may be constructed of a hard polymer material.

Another embodiment of the invention may be a golf teeing device comprising: a top portion; and a base portion, wherein the base portion may comprise one or more extensions. The extensions may be configured to removeably and securely engage with a surface. The top portion may be configured to cradle a golf ball. The golf teeing device may also include a standard tee engagement portion, wherein the standard tee engagement portion may be configured to matingly engage with a standard tee, such that the standard tee may cradle a golf ball. The standard tee engagement portion may be a hole, wherein an edge of the hole may be configured to matingly engage with the standard tee such that the standard tee may cradle the golf ball. The one or more extensions may extend substantially downward and substantially horizontally. The one or more extensions may engage with the surface by rotating the golf teeing device as the one or more extensions are in contact with the surface. The one or more extensions may comprise one or more serrated edges. The surface may be a golf mat. The hole may be configured to matingly engage with a standard tee, such that a height of the standard tee is adjustable. The top portion may comprise a soft polymer material and the base portion may comprise a hard polymer material. There may be four or six extensions, or any other number of extensions. The golf teeing device may further comprise a lanyard anchoring portion, wherein the lanyard anchoring portion is an extrusion on an underside of the golf teeing device. The golf teeing device may further comprise a lanyard, wherein the lanyard comprises one or more loops such that the one or more loops are configured to engage said lanyard anchoring portion. The lanyard anchoring portion may comprise a groove around a circumference outside portion of the lanyard anchoring portion.

Another embodiment of the invention may be a golf teeing device comprising: a top portion; a base portion; and a hole. The hole may extend substantially through the top portion and the base portion. The hole may comprise a raised lip edge on the top portion. The base portion may comprise one or more extensions, which may be configured to removeably and securely engage with a surface. The raised lip edge may be configured to cradle a golf ball. The hole may be configured to matingly engage with the standard tee, such that the standard tee cradles the golf ball. The one or more extensions may be on an outer rim of the base portion and wherein the one or more extensions may extend substantially downward and substantially horizontally from the base portion. The one or more extensions may engage with the surface by rotating the golf teeing device as the one or more extensions are in contact with the surface. The one or more extensions may comprise one or more serrated edges. The surface may be a golf mat. The hole may be configured to matingly engage with a standard tee such that a height of the standard tee, as it rests in the hole, is adjustable. The top portion may comprise a soft polymer material and the base portion may comprise a hard polymer material. The base portion may comprise four or more extensions.

One embodiment may be a golf tee, golf tee holder, and golf teeing device that slides or grips onto the ground or a surface, such as a golf mat. This may allow the user to use the device as a tee or as a holder for a standard golf tee. The standard golf tee, which may typically be constructed as wood or polymer, generally slides into a hole in the middle of the teeing device and is typically held in place as a user tees a ball on the standard tee so that the ball can be struck.

It is an object to provide a golf tee device that claws, slides, and/or grips into a surface, such as an artificial grass golf mat, such that the golf teeing device may be secured, removeably, to the surface while the user hits golf balls. The extensions generally project downwards and horizontally (parallel to the base of the device), to allow the extensions to slide sideways into the surface.

It is another object to provide a golf teeing device that has the ability to hold various golf tees at different tee heights.

It is another object to provide a golf teeing device that eliminates the need to lift a golf mat to engage a tee device with the golf mat.

It is another object to provide a golf teeing device that provides the freedom for tee placement anywhere on the golf mat, convenient for all golfers, left- and right-handed alike.

It is another object to offer a durable, reusable, affordable golf teeing device that securely, but removeably, engages with a surface and acts as both a tee and tee holder. The golf tee device is preferably constructed of hard polymer or metal on a base to keep the device firmly secured into the ground. The hole and top portion of the golf tee device is preferably constructed from a soft polymer (e.g., plastic foam), such that the top portion of the golf tee device is strong enough to withstand a direct hit from a golf club, but soft enough not to damage the golf club.

It is another object to overcome the deficiencies of the prior art.

These, as well as other components, steps, features, objects, benefits, and advantages, will now become clear from a review of the following detailed description of illustrative embodiments, of the accompanying drawings, and of the claims.

BRIEF DESCRIPTION OF THE DRAWINGS

The drawings are of illustrative embodiments, but do not depict all embodiments. Other embodiments may be used in addition to or instead of the illustrative embodiments. Details that may be apparent or unnecessary may be omitted for the purpose of saving space or for more effective illustrations. Some embodiments may be practiced with additional components or steps and/or without some or all components or steps provided in the illustrations. When different drawings contain the same numeral, that numeral refers to the same or similar components or steps.

DETAILED DESCRIPTION OF THE DRAWINGS

In the following detailed description of various embodiments, numerous specific details are set forth in order to provide a thorough understanding of various aspects of the one or more embodiments. However, the one or more embodiments may be practiced without some or all of these specific details. In other instances, well-known procedures and/or components have not been described in detail so as not to unnecessarily obscure aspects of the embodiments.

While some embodiments are disclosed here, still other embodiments of the present will become obvious to those skilled in the art as a result of the following detailed description of embodiments of the invention. The embodiments are capable of modifications of various obvious aspects, all without departing from the spirit and scope of the present disclosure. The Figures, and their detailed descriptions, are to be regarded as illustrative in nature and not restrictive. Also, the reference or non-reference to a particular embodiment of the invention shall not be interpreted to limit the scope of protection.

Figure 1:
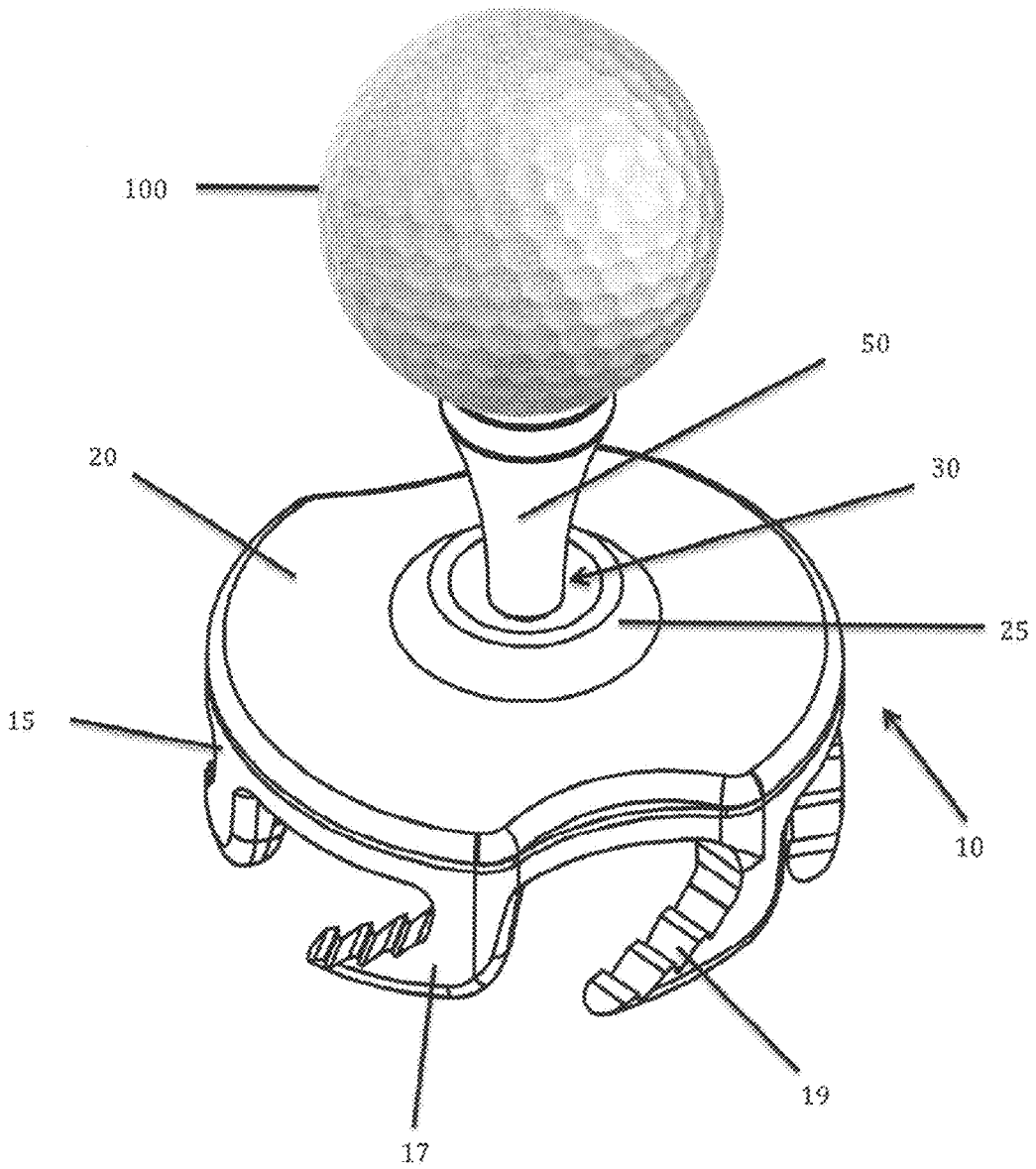
FIG. 1 is an illustration of a perspective view of one embodiment of the golf teeing device and shows the golf teeing device holding a standard golf tee and golf ball.

FIG. 1 is an illustration of a perspective view of one embodiment of the golf teeing device and shows the golf teeing device holding a standard golf tee and golf ball. As shown in FIG. 1, one embodiment of the golf teeing device 10 may comprise: a base portion 15, top portion 20, hole 30, golf ball engagement portion 25 (also referred to as a rim, edge, or raised lip edge), and one or more extensions 17. FIG. 1 shows that the golf teeing device 10 may have more than one extension. The extensions 17 may be pointed protrusions, arms, or claws that are configured to slice, dig, or grip into a surface, such as an artificial grass golf mat. The extensions 17 may also have at least one serrated edge 19 to better grip into the golf mat or ground. It should be understood that, depending on the surface onto which the device 10 will be connected, the golf teeing device 10 may have any number of extensions 17. The extensions 17 may extend downward and horizontally, such that the extensions 17 are substantially parallel with the base 15 and top portion 20. This may allow the extensions 17 to engage with the golf mat by twisting or rotating the golf teeing device 10 while pushing down on the golf teeing device 10 by a user. FIG. 1 also shows that the extensions 17 may be configured to be rotated clockwise to engage with the mat, ground, or surface and counterclockwise to remove the device 10 from the mat, ground, or surface.

The base portion 15 and extensions 17 may be made from a hard polymer or some other durable material, such as metal, but it should be understood that the extensions 17 may be made from any material that is durable. The material may allow the golf teeing device 10 to be engaged securely to a surface, such as an artificial grass mat. The top portion 20 and the raised lip 25 may be made from a soft polymer material, such as plastic, rubber, foam rubber, or foam plastic, but may be made from any durable material that minimizes the damage to a golf club when in contact during a swing. Alternatively, the raised lip 25 may be a separate insert that runs through both the top portion 20 and base portion 15.

FIG. 1 also shows how the hole 30, which may be in the center, or substantially in the center, of the golf teeing device 10, may be configured to engage a standard golf tee 50. Because the hole 30 may be made from a soft polymer material, the hole 30 may releaseably secure and/or engage the tee 50 at various points along the length of the tee 50. This may allow the user to vary the height of the tee 50 as the tee 50 may be held by the golf teeing device 10. Furthermore, this configuration may allow the user to use broken tees with the golf teeing device 10, which may extend the life of many tees that would otherwise be discarded. Although a standard wooden or plastic golf tee is shown in FIG. 1, it should be understood that various tees may be used. FIG. 1 also shows how the tee 50 may be used to hold a golf ball 100. Because the height of the tee 50 may be adjustable, the height of the golf ball 100 may also be adjustable.

Figure 2:
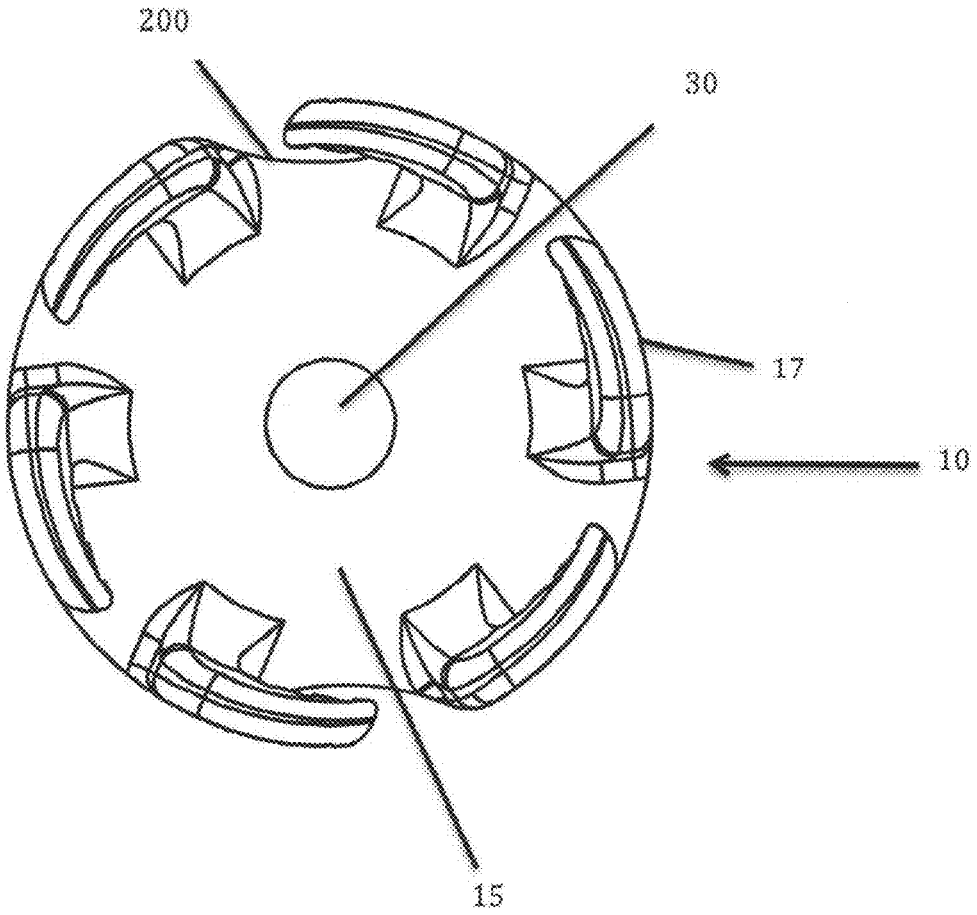
FIG. 2 is an illustration of a bottom view of one embodiment of the golf teeing device.

FIG. 2 is an illustration of a bottom view of one embodiment of the golf teeing device. As shown in FIG. 2, one embodiment of the golf teeing device 10 may comprise a base portion 15, extensions 17, and hole 30. FIG. 2 shows that the device 10 may be substantially circular and include one or more grip notches 200. The grip notches 200 may allow the user to easily twist the golf teeing device into the golf mat or surface. FIG. 2 also shows how the extensions 17 may be curved to match the circular curve of the golf teeing device 10. This may allow the device 10 to more uniformly, securely, and easily twist into the surface. Furthermore, FIG. 2 also shows how the hole 30 may extend through the entire width of the golf teeing device 10 to allow the tee 50 to be secured by the hole 30.

Figure 3:
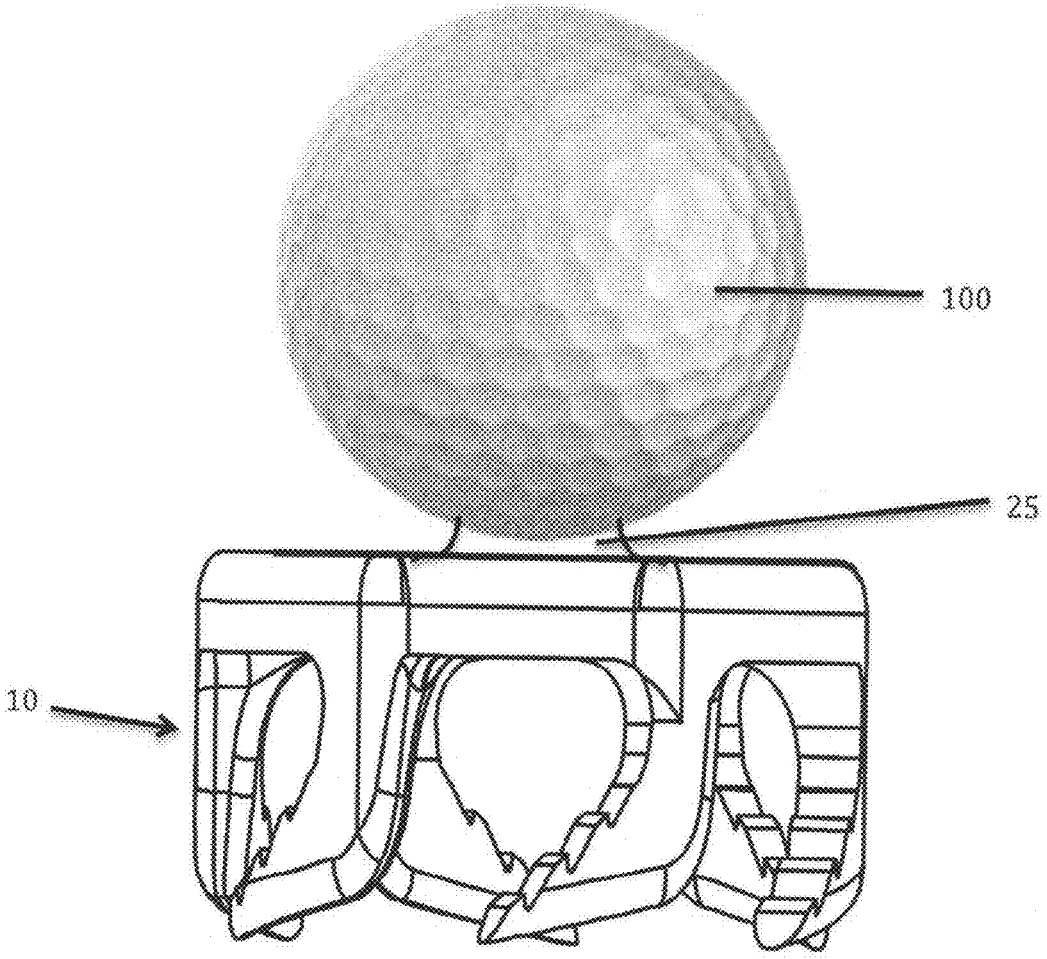
FIG. 3 is an illustration of the side view of another embodiment of the golf teeing device and shows the golf teeing device directly holding a golf ball.

FIG. 3 is an illustration of the side view of another embodiment of the golf teeing device and shows the golf teeing device directly holding a golf ball. As shown in FIG. 3, one embodiment of the golf teeing device 10 may be configured to cradle a golf ball 100. Specifically, the golf ball may be cradled by a golf ball engagement portion 25, which may be the raised lip edge 25 of hole 30. After the golf teeing device 10 is engaged with a surface, the user may place a golf ball 100 on the golf ball engagement portion 25 and then swing at the ball using a golf club.

Figure 4:
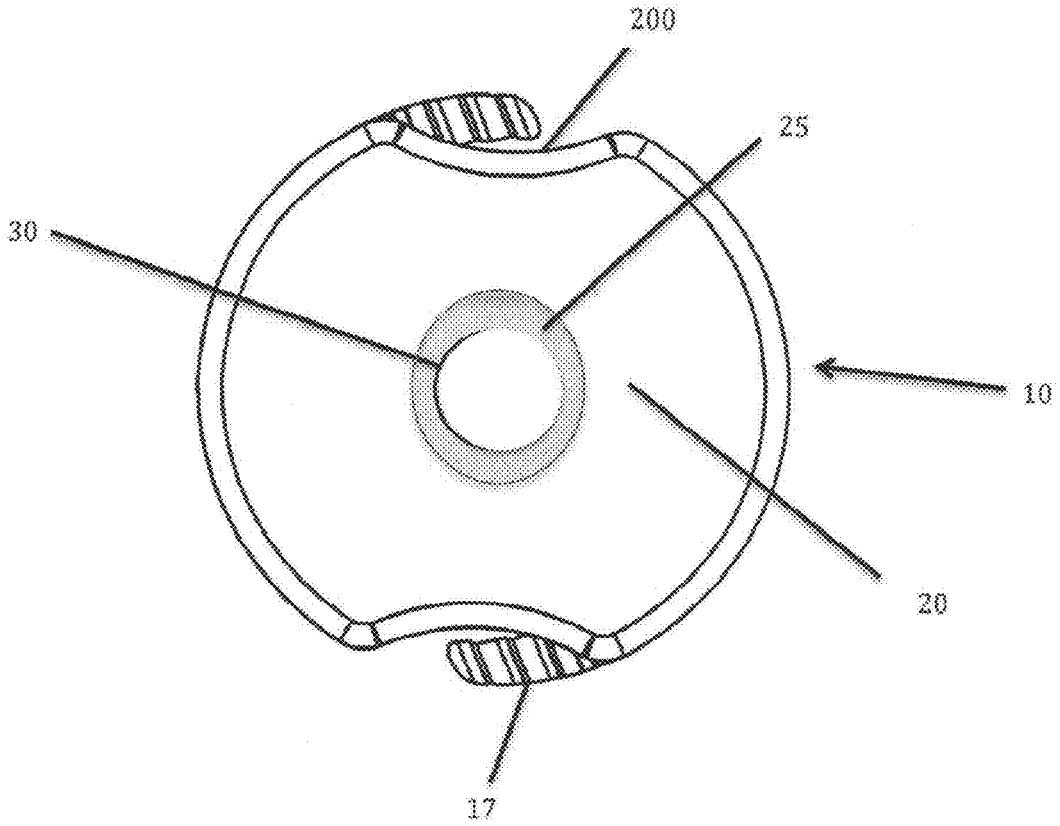
FIG. 4 is an illustration of the top view of one embodiment of the golf teeing device.

FIG. 4 is an illustration of the top view of one embodiment of the golf teeing device. As shown in FIG. 4, one embodiment of the golf teeing device 10 may include top portion 20, hole 30, raised lip edge 25, extension 17, and grip notches 200.

Figure 5:
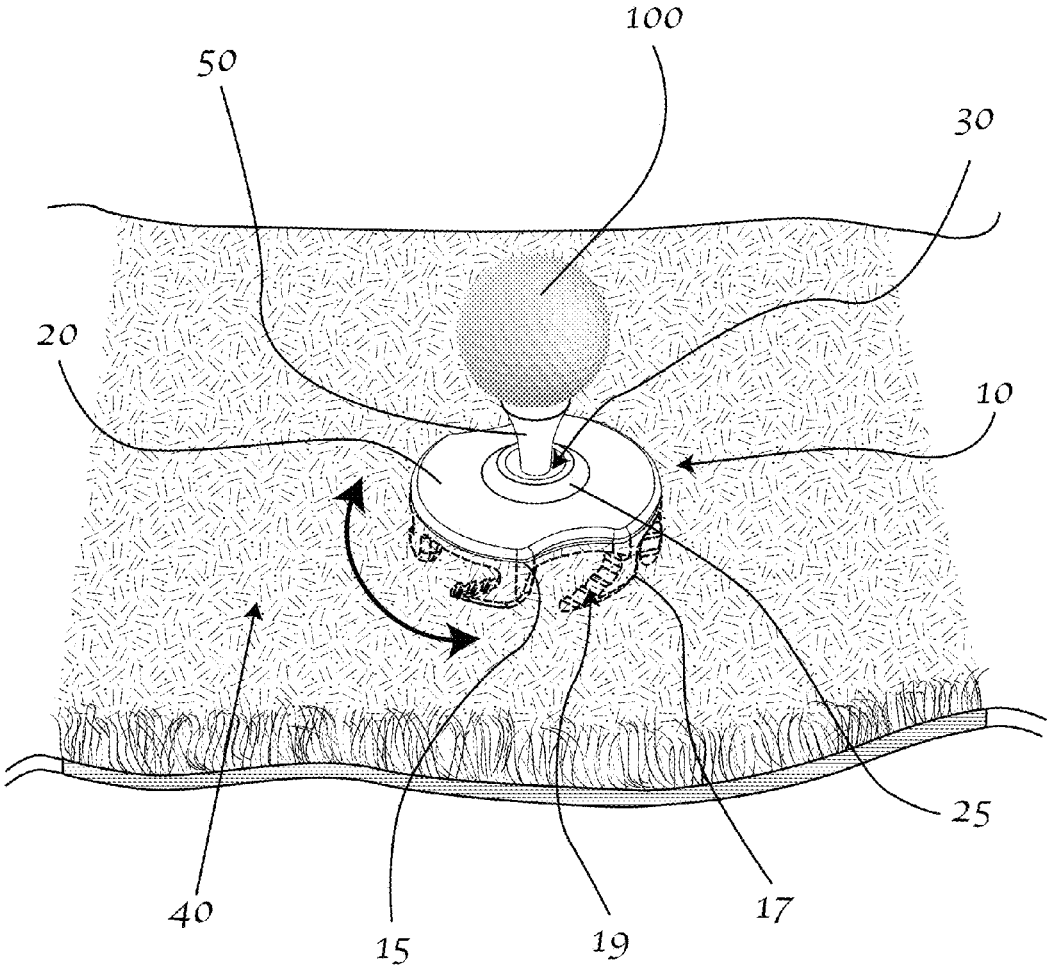
FIG. 5 is an illustration of a perspective view of one embodiment of the golf teeing device and shows the golf teeing device twisted into a surface and holding a standard golf tee and golf ball.

FIG. 5 is an illustration of a perspective view of one embodiment of the golf teeing device and shows the golf teeing device twisted into a surface and holding a standard golf tee and golf ball. As shown in FIG. 5, one embodiment of the golf teeing device 10 may comprise a base portion 15, top portion 20, hole 30, golf ball engagement portion 25, and extensions 17. The extensions 17 may have at least one serrated edge 19 to better grip into a surface, such as an artificial grass golf mat 40. FIG. 5 shows the extensions 17 may engage with the golf mat 40 by twisting or rotating the golf teeing device 10. FIG. 5 shows that the golf teeing device 10 and extensions 17 may be configured to be rotated clockwise to engage with the mat 40, ground, or surface, and counterclockwise to remove the golf teeing device 10 from the mat 40, ground, or surface. FIG. 5 also shows how the hole 30 may be configured to engage a standard golf tee 50, which may be used to hold a golf ball 100.

Figure 6:
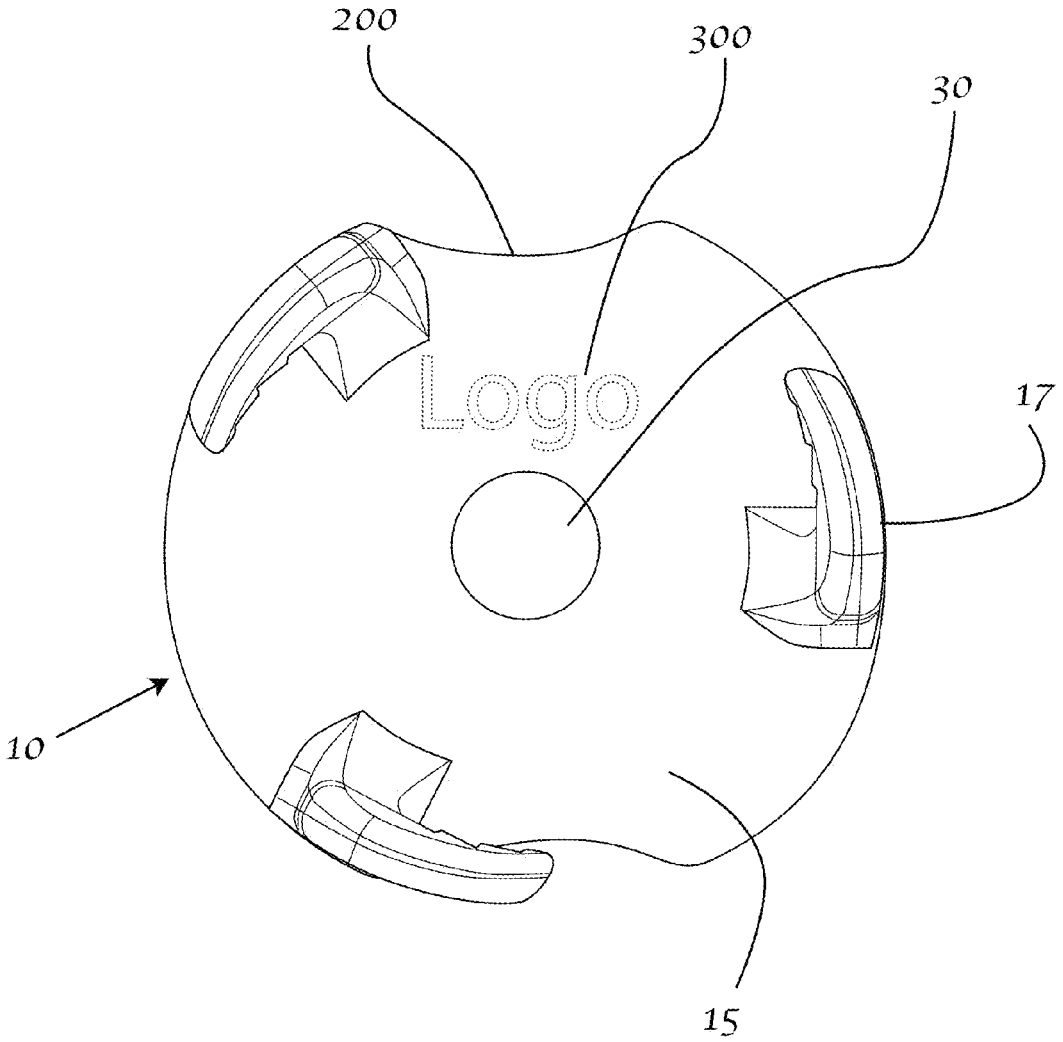
FIG. 6 is an illustration of a bottom view of another embodiment of the golf teeing device.

FIG. 6 is an illustration of a bottom view of another embodiment of the golf teeing device, showing three extensions. As shown in FIG. 6, the golf teeing device 10 may comprise the base portion 15, extensions 17, grip notches 200, hole 30, and brand 300.

Figure 7:
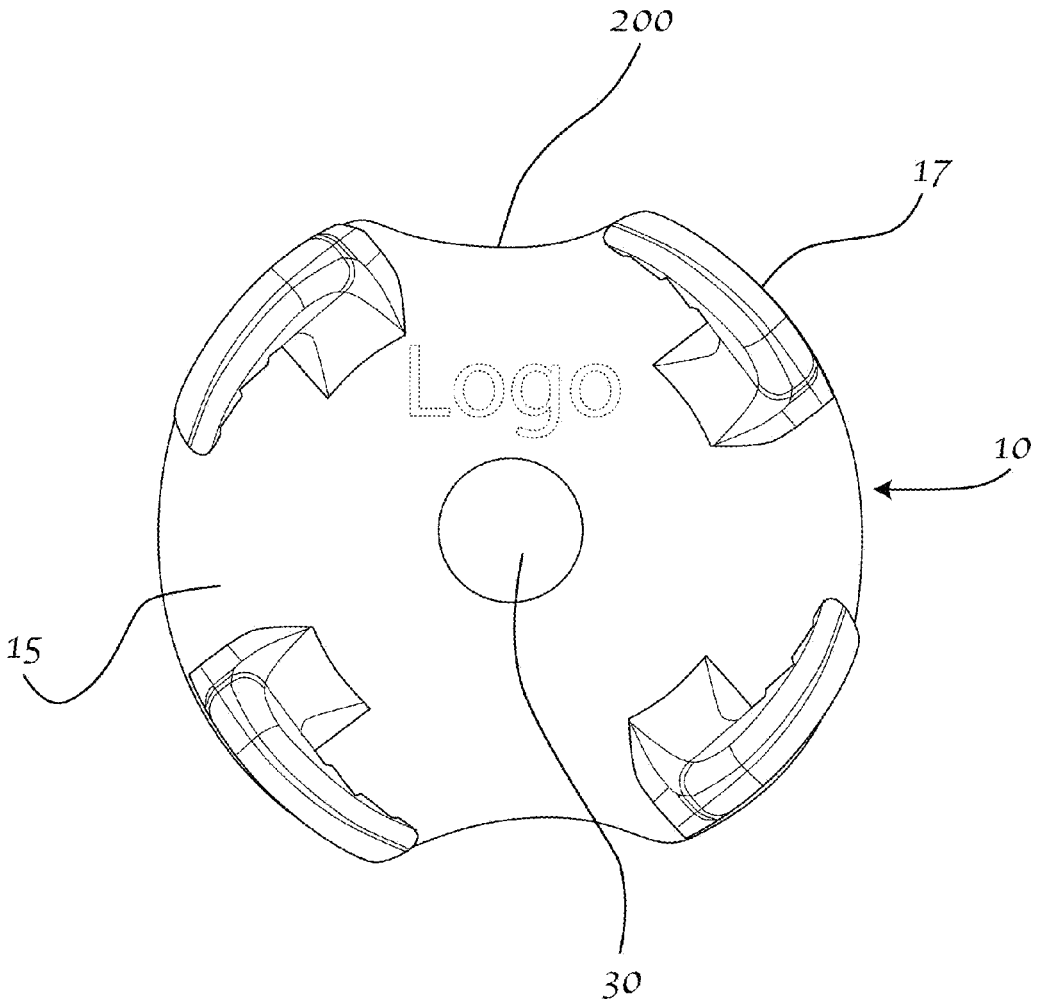
FIG. 7 is an illustration of a bottom view of another embodiment of the golf teeing device.

FIG. 7 is an illustration of a bottom view of another embodiment of the golf teeing device, showing four extensions. As shown in FIG. 7, the golf teeing device 10 may comprise the base portion 15, extensions 17, grip notches 200, and hole 30.

Figure 8:
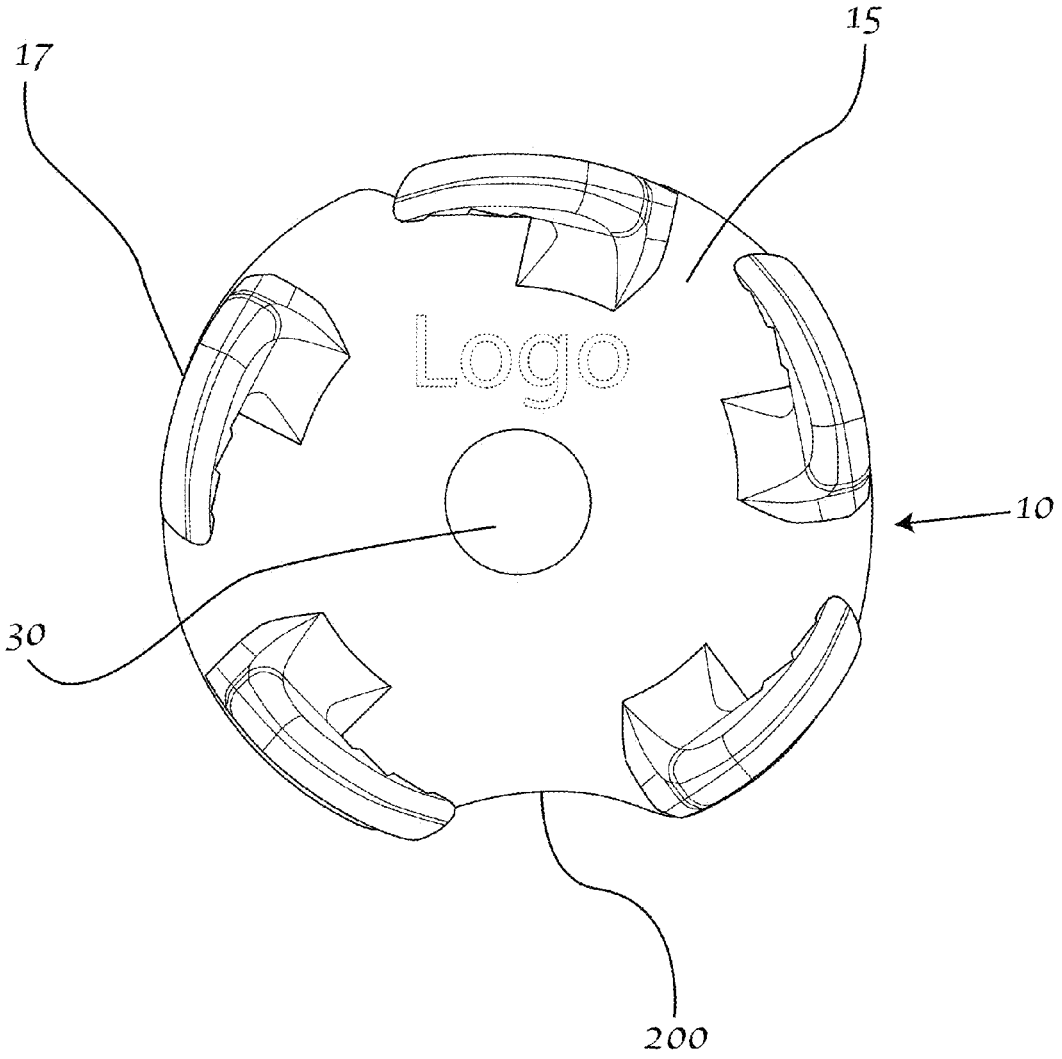
FIG. 8 is an illustration of a bottom view of another embodiment of the golf teeing device.

FIG. 8 is an illustration of a bottom view of another embodiment of the golf teeing device, showing five extensions. As shown in FIG. 8, the golf teeing device 10 may comprise the base portion 15, extensions 17, grip notches 200, and hole 30.

Figure 9:
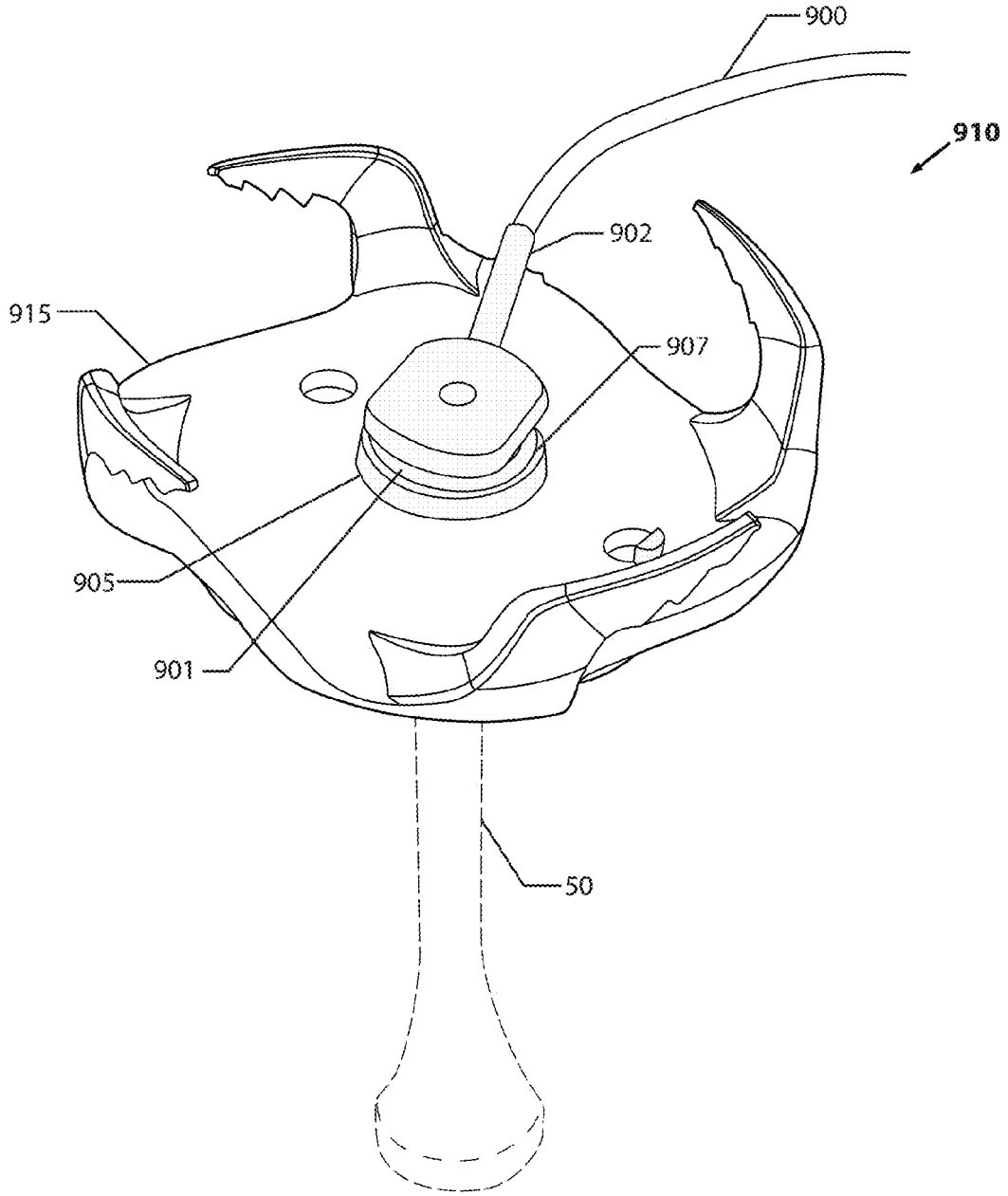
FIG. 9 is an illustration of a bottom perspective view of another embodiment of the golf teeing device with a lanyard.

FIG. 9 is an illustration of a bottom perspective view of another embodiment of the golf teeing device with a lanyard. As shown in FIG. 9, another embodiment of the golf teeing device 910 may further comprise a lanyard 900, and a lanyard anchoring portion 905. The lanyard anchoring portion 905, as shown, may be located on the underside of the golf teeing device 910 and may be substantially at or near the center of the base portion 915. The underside of the golf teeing device 910 may be generally described as the area between the golf teeing device 910 and the surface to be engaged when the golf teeing device 910 is in use. It should be understood the lanyard anchoring portion may be located anywhere on the golf teeing device 910, including, but not limited to: the side(s); top, or extensions. As shown, the lanyard anchoring portion 905 may also comprise a lanyard anchoring portion hole 930. The hole 930 is preferably aligned with hole 30, such that the lanyard anchoring portion hole 930 allows a standard tee 50 to pass, partially or (as shown) entirely through the anchoring portion 905.

Preferably, the lanyard anchoring portion 905 does not have a hole, and a standard tee 50 is substantially prevented from passing through the lanyard anchoring portion 905. In this embodiment, the standard tee 50 passes through hole 30 and stops when it contacts anchoring portion 905. This allows the standard tee 50 to rest loosely within the hole 30, such that when the standard tee 50 is struck by a golf club, it is free to fly out of hole 30 with minimal resistance and the golf teeing device 910 remains in place on the surface.

The lanyard anchoring portion 905 is preferably constructed of a soft polymer such as plastic, but may comprise a hard polymer, a durable material, or any other material which may be capable of serving the purpose of the lanyard anchoring portion 905.

The lanyard anchoring portion 905, as shown, may be substantially circular and may comprise a groove 907. The groove 907 may be positioned along a circumference of the lanyard anchoring portion 905, and may be configured to engage loop 901 of lanyard 900. The groove 907 may be located along a circumference or outer portion of the lanyard anchoring portion 905. The thickness and depth of the groove 907 may be such that a loop 901 of the lanyard 900 is able to rest matingly within groove 907, thereby resisting being detached. In one embodiment, the lanyard 900 may be elastic and therefore able to more securely engage the lanyard anchoring portion by stretching from a relaxed state to fit into the groove 907.

The lanyard anchoring portion 905 may be a protrusion, indentation, ring, loop, catch, button, and/or snap that is configured to removeably, but securely engage the lanyard 900. Alternatively, the lanyard 900 may be permanently attached to lanyard anchoring portion 905. The lanyard 900 may be a cord, line, rope, string, twine, thread, cable, braiding, which is generally flexible, rigid, or elastic. The lanyard 900 may have two ends, a golf tee engagement end, which is typically a loop 901, as shown, and a ground anchor end. The ground anchor end may be configured to removeably, securely, and/or permanently engage the ground, a surface, or a structure that keeps the lanyard 900, and therefore the golf teeing device 910, from flying away in the event that a user hits the device 910 with a golf club during a swing.

The lanyard loop 901 may be formed by folding the end of the lanyard 900 to a portion of the lanyard 900 not at the end of the lanyard 900 and securing the end of the lanyard 900 by a rigid binding 902 or other binding agent. The anchor end may have a similar type of loop, or may end in another type of anchoring or attachment device.

An additional benefit of the lanyard 900 is that, when in use, the lanyard 900 may be laid out in the desired path of the swing. In this manner, the lanyard 900 acts as a visual guide for the golfer, indicating one potential golf club swing path. This potential swing path may be adjusted to allow the golfer to practice various types of swings.

When the lanyard 900 is engaged on one end of the lanyard anchoring portion 905 and secured to the ground or other item at the other end, the lanyard 900 may assist the golfer in locating the golf teeing device 910. Specifically, when the golfer strikes a golf ball positioned on a tee mounted onto the golf teeing device 910 and if the golf teeing device 910 is struck or otherwise moved, the golf teeing device 910 may be easy to locate due to being effectively secured to the ground via the lanyard 900.

In another embodiment, the lanyard anchoring portion 905 may be a separate portion of the golf teeing device 910 or may be a seamless extension of the golf teeing device 910.

Additionally, the lanyard 900 may act as a golf training aid. For example, the lanyard 900 may apply a directional force or secure the golf teeing device 910 to a specific point. Additionally, the lanyard 900 may provide the user with a point of reference which may allow the user to visualize how to swing the golf club. By allowing a user to visualize a directional path useful for swinging a golf club and striking a golf ball, the user may then swing using a more efficient swing path than they may have performed otherwise. By applying directional force to the golf teeing device 910, the user may cause the golf teeing device 910 to be not level, and therefore allow the golfer to practice different swings with a visual aid.

Figure 10:
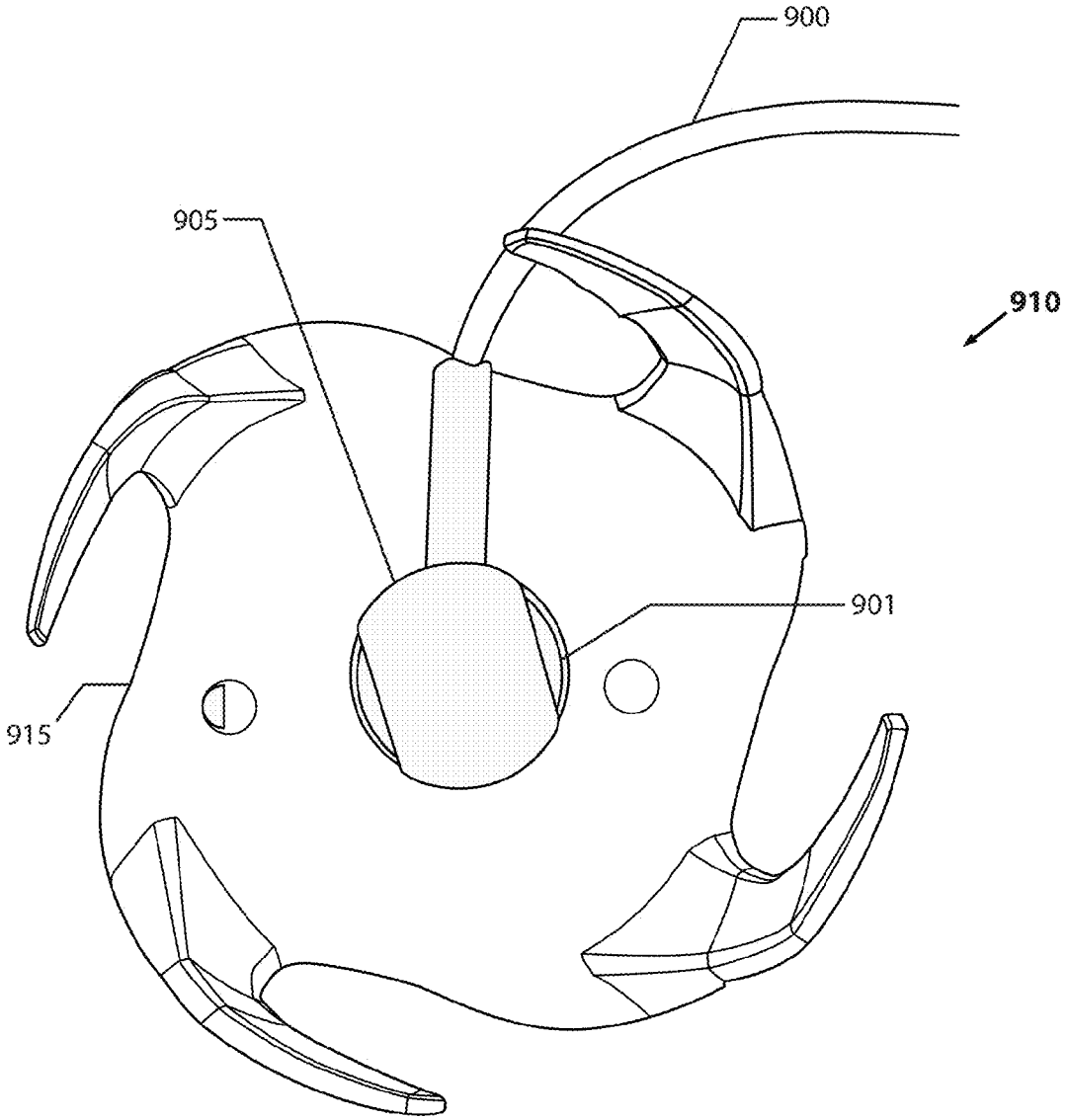
FIG. 10 is an illustration of a bottom view of another embodiment of the golf teeing device with a lanyard.

FIG. 10 is an illustration of a bottom view of another embodiment of the golf teeing device with a lanyard. As shown in FIG. 10, another embodiment of the golf teeing device 910 may comprise a lanyard anchoring portion 905, which may be engaged with loop 901 of lanyard 900. The anchoring groove 907 may be located along a circumference or outer portion of the lanyard anchoring portion 905. The thickness and depth of the groove 907 may be such that a looped end of the lanyard 900 may be able to rest along the groove 907, thereby resisting being detached. In one embodiment, the lanyard 900 is elastic and therefore able to more securely engage the lanyard anchoring portion by stretching from a relaxed state to fit onto the groove 907. FIG. 10 also shows how hold 930 preferably aligns with hole 30, so as to allow a standard tee 50 to engage with golf teeing device 910.

Unless otherwise stated, all measurements, values, ratings, positions, magnitudes, sizes, locations, and other specifications that are set forth in this specification, including in the claims that follow, are approximate, not exact. They are intended to have a reasonable range that is consistent with the functions to which they relate and with what is customary in the art to which they pertain.

The foregoing description of the preferred embodiment has been presented for the purposes of illustration and description. While multiple embodiments are disclosed, still other embodiments will become apparent to those skilled in the art from the above detailed description, which shows and describes illustrative embodiments. The embodiments may be capable of modifications in various obvious aspects, all without departing from the spirit and scope of the present disclosure. Accordingly, the detailed description is to be regarded as illustrative in nature and not restrictive. Also, although not explicitly recited, one or more embodiments of the invention may be practiced in combination or conjunction with one another. Furthermore, the reference or non-reference to a particular embodiment of the invention shall not be interpreted to limit the scope of the disclosure. It is intended that the scope of protection be not be limited by this detailed description, but by the claims and the equivalents to the claims that are appended hereto.

Except as stated immediately above, nothing that has been stated or illustrated is intended or should be interpreted to cause a dedication of any component, step, feature, object, benefit, advantage, or equivalent, to the public, regardless of whether it is or is not recited in the claims.

What is claimed is:

1. A golf teeing device comprising:

a top portion;

a base portion; and a lanyard anchoring portion;

wherein said base portion comprises two or more extensions;

wherein said two or more extensions are configured to removeably and securely engage with a surface;

wherein said top portion is configured to cradle a golf ball;

wherein said two or more extensions are located substantially near an outer rim of said base portion; and wherein said two or more extensions are substantially hooked-shaped, such that said two or more extensions first extend substantially downward away from said base portion and then extend substantially horizontal and substantially parallel to said base portion.

2. The golf teeing device of claim 1, further comprising:

a lanyard;

wherein said lanyard is configured to engage with said lanyard anchoring portion.

3. The golf teeing device of claim 1, further comprising:

a standard tee engagement portion;

wherein said standard tee engagement portion is configured to matingly engage with a standard tee, such that said standard tee cradles a golf ball.

4. The golf teeing device of claim 3, wherein said standard tee engagement portion comprises a hole;

wherein an edge of said hole is configured to matingly engage with said standard tee, such that said standard tee cradles said golf ball.

5. The golf teeing device of claim 1, wherein said lanyard anchoring portion is an extrusion on an underside of said golf teeing device.

6. The golf teeing device of claim 4, wherein said lanyard anchoring portion is an extrusion on an underside of said golf teeing device; and wherein said lanyard anchoring portion is aligned with said hole, such that a standard tee that engages with said hole is substantially prevented from passing through said lanyard anchoring portion.

7. The golf teeing device of claim 6, wherein said lanyard comprises one or more loops such that said one or more loops are configured to engage said lanyard anchoring portion.

8. The golf teeing device of claim 7, wherein said lanyard anchoring portion is substantially circular and comprises a groove around a circumference outside portion of said lanyard anchoring portion; and wherein said groove is configured to matingly engage with said one or more loops of said lanyard.

9. The golf teeing device of claim 8, wherein said base portion further comprises one or more grip notches.

10. The golf teeing device of claim 1, wherein each of said two or more extensions are placed equidistant from each other along said outer rim of said base portion, is hooked in the same direction as each other, and is configured to engage with said surface by rotating said golf teeing device as said two or more extensions are in contact with said surface.

11. The golf teeing device of claim 10, wherein said two or more extensions comprise one or more serrated edges.

12. The golf teeing device of claim 11, wherein said hole is configured to matingly engage with a standard tee, such that a height of a golf ball placed on said standard tee is adjustable.

13. The golf teeing device of claim 12, wherein said surface is a golf mat.

14. The golf teeing device of claim 13, wherein said top portion is constructed of a soft polymer material.

15. The golf teeing device of claim 14, wherein said base portion is constructed of a hard polymer material.

16. The golf teeing device of claim 15, wherein said two or more extensions are four extensions.

17. A golf teeing device comprising:

a top portion;

a base portion; and a lanyard anchoring portion;

wherein said base portion comprises two or more extensions;

wherein said two or more extensions are configured to removeably and securely engage with a surface;

wherein said top portion is configured to cradle a golf ball; and wherein said two or more extensions are substantially hooked-shaped, such that said two or more extensions first extend substantially downward away from said base portion and then extend substantially horizontal and substantially parallel to said base portion; and wherein said two or more extensions are located substantially near an outer rim of said base portion.

18. The golf teeing device of claim 17, further comprising:

a lanyard; and a standard tee engagement portion;

wherein said lanyard is configured to engage with said lanyard anchoring portion;

wherein said standard tee engagement portion is configured to matingly engage with a standard tee, such that said standard tee cradles a golf ball;

wherein said standard tee engagement portion comprises a hole;

wherein an edge of said hole is configured to matingly engage with said standard tee, such that said standard tee cradles said golf ball; and wherein said lanyard anchoring portion is an extrusion on an underside of said golf teeing device.

19. The golf teeing device of claim 18, wherein said lanyard comprises one or more loops such that said one or more loops are configured to engage said lanyard anchoring portion;

wherein said lanyard anchoring portion is substantially circular and comprises a groove around a circumference outside portion of said lanyard anchoring portion;

wherein said groove is configured to matingly engage with said one or more loops of said lanyard;

wherein said base portion further comprises one or more grip notches;

wherein each of said two or more extensions are placed equidistant from each other along said outer rim of said base portion, is hooked in the same direction as each other, and is configured to engage with said surface by rotating said golf teeing device as said two or more extensions are in contact with said surface;

wherein said two or more extensions comprise one or more serrated edges;

wherein said top portion is constructed of a soft polymer material; and wherein said base portion is constructed of a hard polymer material.

* * * * *